US008177232B2

(12) United States Patent
Supron

(10) Patent No.: US 8,177,232 B2
(45) Date of Patent: May 15, 2012

(54) METHODS AND APPARATUS FOR STACKING TICKETS IN A TICKET PRINTER WITH AN ALTERNATE TICKET EXIT

(75) Inventor: Steven A. Supron, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 163 days.

(21) Appl. No.: 12/657,397

(22) Filed: Jan. 19, 2010

(65) Prior Publication Data

US 2011/0175283 A1 Jul. 21, 2011

(51) Int. Cl.
*B65H 29/00* (2006.01)

(52) U.S. Cl. ..... 271/279; 271/207

(58) Field of Classification Search ..... 271/279, 271/207, 302

See application file for complete search history.

(56) References Cited

U.S. PATENT DOCUMENTS

| | | | | |
|---|---|---|---|---|
| 5,332,210 | A | 7/1994 | Silverberg et al. | |
| 5,464,317 | A | 11/1995 | Foster et al. | |
| 6,308,952 | B1 * | 10/2001 | Takagi et al. | 271/297 |
| 6,602,008 | B2 * | 8/2003 | Yamagishi et al. | 400/619 |
| 2011/0140338 | A1 * | 6/2011 | Supron et al. | 270/52.03 |

* cited by examiner

*Primary Examiner* — Michael McCullough

(74) *Attorney, Agent, or Firm* — Lipsitz & McAllister, LLC

(57) ABSTRACT

An alternate ticket exit is provided in the event of a blockage of the primary ticket exit of a printer. Printed tickets are fed from a stacking nip into a ticket bin via a first ticket exit. A second ticket exit is provided which leads away from the ticket bin. Tickets are diverted into the second ticket exit in the event the ticket bin has reached capacity or the first ticket exit is blocked. By diverting tickets out of the second exit when the ticket bin has reached capacity or when the first ticket exit is blocked, the tickets are allowed to exit the printer and paper jams are prevented.

8 Claims, 2 Drawing Sheets

METHODS AND APPARATUS FOR STACKING TICKETS IN A TICKET PRINTER WITH AN ALTERNATE TICKET EXIT

BACKGROUND OF THE INVENTION

The present invention relates to methods and apparatus for stacking paper tickets, receipts, vouchers and the like that exit a transaction-based printer. An alternate ticket exit is provided in the event of a blockage of the primary ticket exit.

BACKGROUND OF THE INVENTION

High speed printers, such as inkjet, thermal, dye sublimation and dot matrix printers are used to provide vouchers, coupons, tickets, receipts and the like (all generally referred to herein as "tickets") to consumers. For example, when a winning lottery prize becomes relatively large, the lines at ticket sales counters become long. In addition, the number of tickets purchased by each person in the line can be relatively large. Most point of sales (POS) and other transaction-based printers have been designed to issue one ticket, voucher, coupon or receipt at a time. Sales personnel are therefore required to remove each printed sheet manually from the printer. When a number of lottery or wagering tickets, for example, are purchased in a single transaction, the sales person must compile all of the tickets for that transaction by hand. This can be a time consuming procedure leading to errors being made and long delays in ticket sales.

In printers that are able to issue more than one ticket at a time, problems develop due to the commonly used roll-type paper stock used in such printers, which causes the cut tickets to curl upon being ejected from the printer. A curled ticket may block the printer's ticket exit, such that subsequent tickets may be stacked out of order or pushed out of the ticket bin.

In addition, other problems may result in a blocked ticket exit, such as an overly full ticket bin or foreign objects blocking the exit:

In such cases where the primary ticket exit becomes blocked, it would be advantageous to provide methods and apparatus for stacking multiple tickets where the tickets have an alternate exit in the event of a blockage of the primary ticket exit. Such a function would be particularly advantageous for high speed printers that dispense quantities of tickets, vouchers, receipts, coupons and other printed substrates. Such printers are often used in wagering and lottery terminals, as well as in other point of sale terminals such as those used to print train tickets, bus tickets, movie and theater tickets, retail coupons, and other substrates of value.

The present invention provides methods and apparatus for stacking tickets in a printer having the aforementioned and other advantages.

SUMMARY OF THE INVENTION

The present invention relates to methods and apparatus for stacking paper tickets, receipts, vouchers and the like that exit a transaction-based printer. An alternate ticket exit is provided in the event of a blockage of the primary ticket exit.

In one example embodiment for stacking tickets in a ticket printer With an alternate ticket exit in accordance with the present invention, printed tickets are fed from a stacking nip into a ticket bin via a first ticket exit. A second ticket exit is provided which leads away from the ticket bin. Tickets are diverted into the second ticket exit in the event the ticket bin has reached capacity or the first ticket exit is blocked. By diverting tickets out of the second exit when the ticket bin has reached capacity or when the first ticket exit is blocked, the tickets are allowed to exit the printer and paper jams are prevented.

A stacking deflector may be provided for biasing tickets fed via the first ticket exit into a stacking position in the ticket bin. The second ticket exit may be provided between the stacking nip and the stacking deflector.

A top cover may be provided which covers the stacking nip and forms the ticket bin. A mid-frame cover may be provided which covers a printing mechanism. The first ticket exit may be formed in the cover above the stacking nip. The second ticket exit may be formed between the top cover and the mid-frame cover.

At least one of a material of the stacking deflector, height of the stacking deflector, geometry of the stacking defector, position of the stacking deflector, upper stop position of the stacking deflector, angle of the stacking deflector with respect to the stacking nip, length of the ticket, curl of the ticket, humidity, or friction may determine the capacity of the ticket bin.

When the tickets are diverted to the second ticket exit, the diverted tickets buckle against one of the blocked first ticket exit or stacked tickets when the capacity of the ticket bin is reached. As a result, the buckled tickets extend from the second ticket exit.

Once a blockage is removed or the ticket bin is emptied after reaching capacity, the feeding of tickets into the ticket bin via the first ticket exit can be resumed.

A stacker for stacking tickets in a ticket printer with an alternate ticket exit is also provided in accordance with the present invention. In an example embodiment, the stacker may comprise a first ticket exit adapted to feed printed tickets from a stacking nip into a ticket bin, a second ticket exit leading away from the ticket bin and adapted to accept tickets diverted from the first ticket exit in the event the ticket bin has reached capacity or the first ticket exit is blocked.

The stacker may also include additional features discussed above in connection with the various method embodiments.

BRIEF DESCRIPTION OF THE DRAWINGS

The present invention will hereinafter be described in conjunction with the appended drawing figure, wherein.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to methods and apparatus for stacking paper tickets in a printer, in which an alternate ticket exit is provided in the event of a blockage of the primary ticket exit. It should be appreciated that the term "ticket" as used herein encompasses not only tickets (e.g., lottery tickets, etc.) but also any similar type of document, including vouchers, coupons, receipts and the like.

Figure 1:
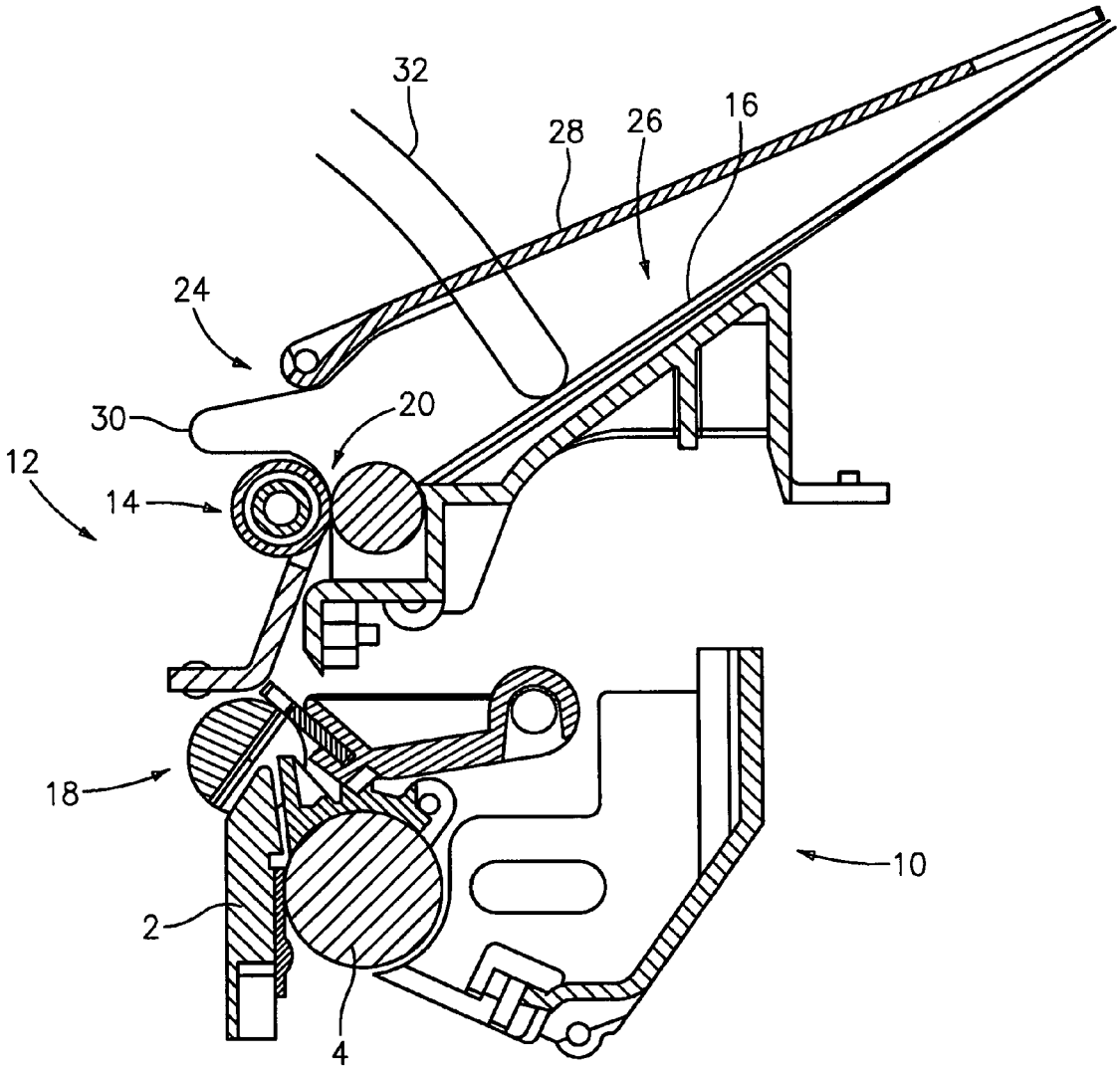
FIG. 1 shows an example embodiment of an apparatus in accordance with the present invention.

An example embodiment of a ticket printer having a ticket stacker with an alternate ticket exit in accordance with the present invention is shown in FIG. 1. The printer includes a printing mechanism 10 and a stacking mechanism 12. The printing mechanism 10 includes a print head 2, a platen 4, and a cutter assembly 18 comprising a rotary knife and a fixed blade. Portions of the printer which are not relevant to the explanation of the present invention are omitted for clarity and would be apparent to those skilled in the art. A stacking nip 14 is provided which is adapted to accept tickets 16 from the ticket cutter 18 after printing. Printed tickets 16 are fed from the stacking nip 14 into a ticket bin 26 via a first ticket exit 20 leading into the ticket bin 26. A second ticket exit 24 is provided which leads away from the ticket bin 26. Tickets 30 are diverted into the second ticket exit 24 in the event the ticket bin 26 has reached capacity or the first ticket exit 20 is blocked. By diverting tickets 30 out of the second exit 24 when the ticket bin 26 has reached capacity or when the first ticket exit 20 is blocked, the tickets 30 are allowed to exit the printer and paper jams are prevented.

For example, FIG. 1 shows a number of tickets 16 in a stacking position in the ticket bin 26 and a finger 32 blocking the first ticket exit 20. The next ticket to be printed, ticket 30, will be unable to enter the ticket bin 26 via the first (primary) exit 20 due to the blockage caused by finger 32 and will therefore exit the printer via the alternate second exit 24. It should be appreciated that the blockage caused by the finger 32 is shown in FIG. 1 as one example of a type of blockage that can occur, and those skilled in the art will appreciate that a blockage may occur due in many different ways, such as by a foreign object falling into the ticket bin 26, breakage of a part of the printer which obstructs the first ticket exit 20 (e.g., the deflector 28 or a part of the printer cover). or simply an overfull ticket bin 26 which has reached capacity. As a further example, in the event the ticket bin 26 fills to capacity with printed tickets 16, the tickets 16 in the ticket bin 26 will prevent further tickets (such as ticket 30), from entering into the first exit 20 and being deposited into the ticket bin 26.

A stacking deflector 28 may be provided for biasing tickets 16 fed via the first ticket exit 20 into a stacking position in the ticket bin 26. The second ticket exit 24 may be provided between the stacking nip 14 and the stacking deflector 28.

Figure 2:
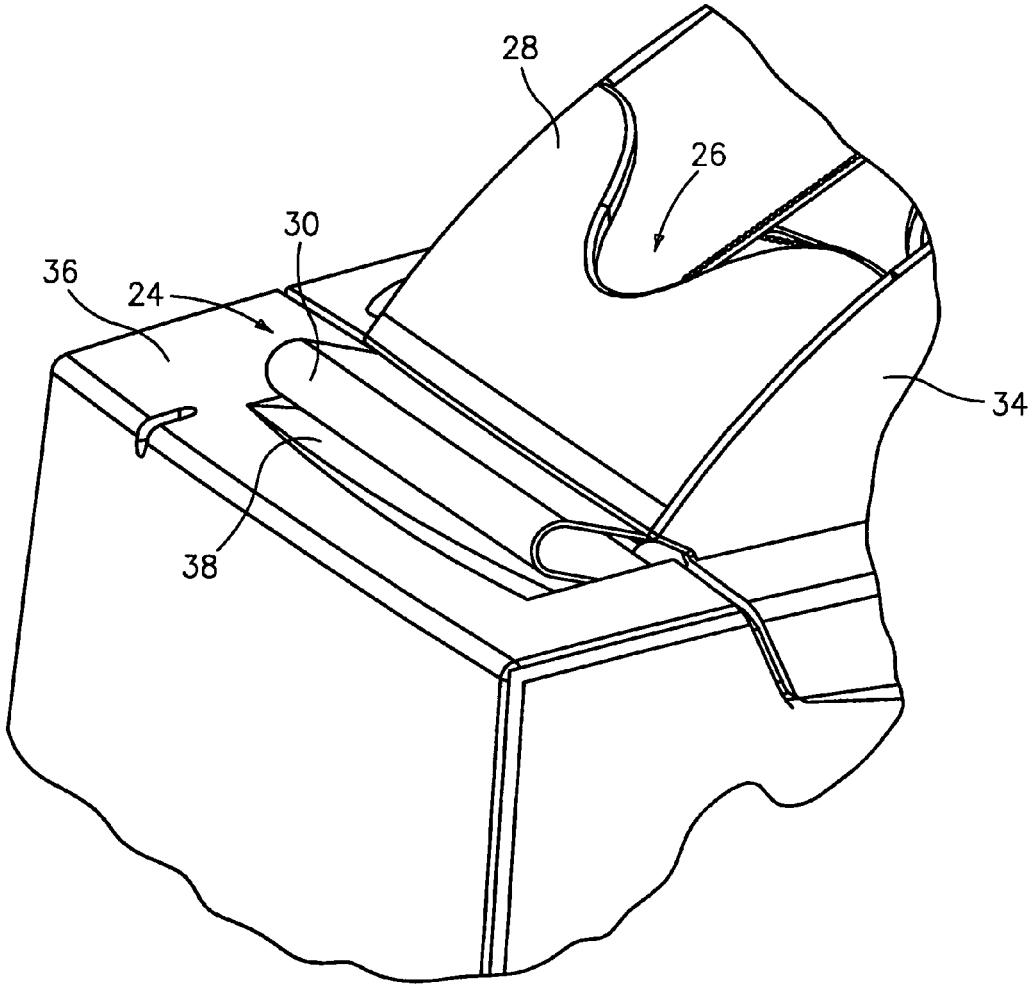
FIG. 2 shows an example embodiment of a printer in accordance with the present invention.

As shown in FIG. 2, a top cover 34 may be provided which covers the stacking nip 14 and forms the ticket bin 26. A mid-frame cover 36 may be provided which covers the printing mechanism. The first ticket exit 20 may be formed in a top portion of the cover 34 above the stacking nip 14 (e.g., underneath or below the deflector 28 of FIG. 2). The second ticket exit 24 may be formed between the top cover 34 and the mid-frame cover 36. The mid-frame cover 36 may have an inclined or recessed portion 38 which receives the ticket 30 as it leaves the second exit 24. This same recessed portion 38 may be used as a paper guide for loading tickets into the printer.

At least one of a material, height, geometry, position, upper stop position, or angle of the stacking deflector 28 with respect to the stacking nip 14 may determine the capacity of the ticket bin 26. For example, since the first exit 20 may be blocked by a stack of tickets 16 in the ticket bin 26 when the tickets 16 in the ticket bin 26 accumulate sufficiently to contact the deflector 28, these parameters will impact when the ticket bin 26 is "full". In addition, the length of the tickets 16 or the "curl" of the tickets 16 in the ticket bin 26 may also impact when the ticket bin 26 is full. As the curl of the ticket 16 may be affected by the humidity, the humidity will also impact the capacity of the ticket bin 26. Friction between tickets and between the tickets and the deflector 28 or the ticket bin 26 may also impact when the ticket bin 26 reaches capacity.

When the tickets 30 are diverted to the second ticket exit 24, the diverted tickets 30 buckle against one of the blocked first ticket exit 20 or stacked tickets 16 when the capacity of the ticket bin 26 is reached. As a result, the buckled portion of each blocked ticket 30 may extend out of the second ticket exit 24. The buckled ticket 30 is advanced by the stacking nip 14 until the trailing edge of the ticket 30 exits the stacking nip 14. Depending on the length of the ticket 30, the ticket 30 may remain buckled in the second exit 24 (as shown in FIG. 2) or may-fall out of the second exit and into the recessed portion 38.

Once a blockage is removed or the ticket bin 26 is emptied after reaching capacity, the feeding of tickets into the ticket bin 26 via the first ticket exit 20 can be resumed.

It should now be appreciated that the present invention provides advantageous methods and apparatus for stacking tickets in a ticket printer, which provides an alternate ticket. exit in the event of a blockage or a full ticket bin.

Although the invention has been described in connection with various illustrated embodiments, numerous modifications and adaptations may be made thereto without departing from the spirit and scope of the invention as set forth in the claims.

What is claimed is:

1. A method for stacking tickets in a ticket printer with an alternate ticket exit, comprising:

feeding printed tickets from a stacking nip into a ticket bin via a first ticket exit;

providing a second ticket exit, the second ticket exit leading away from said ticket bin;

biasing tickets fed via the first ticket exit into a stacking position in the ticket bin via a stacking deflector;

wherein:

said second ticket exit is provided between the stacking nip and the stacking deflector;

tickets are diverted into the second ticket exit in the event the ticket bin has reached capacity or the first ticket exit is blocked;

when the tickets are diverted to the second ticket exit, the diverted tickets buckle against one of the blocked first ticket exit or stacked tickets when the capacity of the ticket bin is reached; and the buckled tickets extend from the second ticket exit.

2. A method in accordance with claim 1, wherein:

a top cover is provided which covers the stacking nip and forms the ticket bin;

a mid-frame cover is provided which covers a printing mechanism;

the first ticket exit is formed in the top cover above the stacking nip; and the second ticket exit is formed between the top cover and the mid-frame cover.

3. A method in accordance with claim 1, wherein at least one of a material of the stacking deflector, height of the stacking deflector, geometry of the stacking deflector, position of the stacking deflector, upper stop position of the stacking deflector, angle of the stacking deflector with respect to the stacking nip, length of the ticket, curl of the ticket, humidity, or friction determines the capacity of the ticket bin.

4. A method in accordance with claim 1, further comprising:

resumption of feeding of tickets into the ticket bin via the first ticket exit once a blockage is removed or the ticket bin is emptied after reaching capacity.

5. A stacker for stacking tickets in a ticket printer with an alternate ticket exit, comprising:

a first ticket exit adapted to feed printed tickets from a stacking nip into a ticket bin;

a second ticket exit, the second ticket exit leading away from said ticket bin and adapted to accept tickets diverted from the first ticket exit in the event the ticket bin has reached capacity or the first ticket exit is blocked; and a stacking deflector, tickets fed via the first ticket exit being biased into a stacking position in the ticket bin by the stacking deflector;

wherein:

said second ticket exit is provided between the stacking nip and the stacking deflector;

when the tickets are diverted to the second ticket exit, the diverted tickets buckle against one of the blocked first ticket exit or stacked tickets when the capacity of the ticket bin is reached; and the buckled tickets extend from the second ticket exit.

6. A stacker in accordance with claim 5, further comprising:

a top cover which covers the stacking nip and forms the ticket bin; and a mid-frame cover which covers a printing mechanism, wherein:

the first ticket exit is formed in the cover above the stacking nip; and the second ticket exit is formed between the top cover and the mid-frame cover.

7. A stacker in accordance with claim 5, wherein at least one of a material of the stacking deflector, height of the stacking deflector, geometry of the stacking deflector, position of the stacking deflector, upper stop position of the stacking deflector, angle of the stacking deflector with respect to the stacking nip, length of the ticket, curl of the ticket, humidity, or friction determines the capacity of the ticket bin.

8. A stacker in accordance with claim 5, wherein:

feeding of tickets into the ticket bin via the first ticket exit resumes once a blockage is removed or the ticket bin is emptied after reaching capacity.

* * * * *